US006230131B1

(12) United States Patent
Kuhn et al.

(10) Patent No.: US 6,230,131 B1
(45) **Date of Patent: *May 8, 2001**

(54) METHOD FOR GENERATING SPELLING-TO-PRONUNCIATION DECISION TREE

(75) Inventors: Roland Kuhn; Jean-Claude Junqua; Matteo Contolini, all of Santa Barbara, CA (US)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/069,308

(22) Filed: Apr. 29, 1998

(51) Int. Cl.[7] ..... G10L 13/08
(52) U.S. Cl. ..... 704/266; 704/267
(58) Field of Search ..... 704/10, 243, 245, 704/254, 255, 266, 260, 267; 707/100, 102

(56) References Cited

U.S. PATENT DOCUMENTS 5,729,656 * 3/1998 Nahamoo et al. ..... 704/255
5,794,197 * 8/1998 Alleva et al. ..... 704/255

OTHER PUBLICATIONS

Anderson et al., "Comparison of two tree–structured approaches for grapheme–to–phoneme conversion", ICSLP 96. Proceedings of the Fourth International Conference on Spoken Language, vol.: 3, pp.: 1700–1703, 1996.*
Bahl et al., "Decision trees for phonological rules in continuous speech," ICASSP–91, 1991 International Conference on Acoustics, Speech, and Signal Processing, vol. 1,pp.: 185–188.*
Tuerk et al., "The development of a connectionist multiple–voice text–to–speech system", ICASSP–91, 1991 International Conference on Acoustics, Speech, and Signal Processing, vol. 1,pp.: 749–752.*

* cited by examiner

*Primary Examiner*—Richemond Dorvil
*Assistant Examiner*—Angela Armstrong
(74) *Attorney, Agent, or Firm*—Harness, Dickey & Pierce, P.L.C.

(57) ABSTRACT

Decision trees are used to store a series of yes-no questions that can be used to convert spelled-word letter sequences into pronunciations. Letter-only trees, having internal nodes populated with questions about letters in the input sequence, generate one or more pronunciations based on probability data stored in the leaf nodes of the tree. The pronunciations may then be improved by processing them using mixed trees which are populated with questions about letters in the sequence and also questions about phonemes associated with those letters. The mixed tree screens out pronunciations that would not occur in natural speech, thereby greatly improving the results of the letter-to-pronunciation transformation.

14 Claims, 4 Drawing Sheets

METHOD FOR GENERATING SPELLING-TO-PRONUNCIATION DECISION TREE

BACKGROUND AND SUMMARY OF THE INVENTION

The present invention provides a novel data structure stored within a computer-readable memory and a method for generating this data structure. The invention provides an important component that may be used to address the above letter-to-pronunciation problems. Specifically, the invention provides a mixed decision tree having a plurality of internal nodes and a plurality of leaf nodes. A typical implementation would employ one of these mixed decision trees for each letter in the alphabet.

The internal nodes are each populated with a yes-no question. The decision tree is mixed in that some of these questions pertain to a given letter and its neighboring letters in a spelled word sequence. Others of these questions pertain to a given phoneme and its neighboring phonemes in a pronunciation or phoneme sequence corresponding to the spelled word. The letters of the spelled word are aligned with the corresponding phonemes in the pronunciation sequence. The leaf nodes are populated with probability data, obtained during training upon a known corpus, that ranks or scores different phonetic transcriptions of the given letter. The probability data can be used, for example, to select the best pronunciation of a spelled name from a list of hypotheses generated by an upstage process. The probability data can also be used to score pronunciations developed by lexicographers to allow questionable transcriptions to be quickly identified and corrected.

According to the invention, these mixed decision trees are generated by providing two sets of yes-no questions, a first set pertaining to letters and their adjacent neighbors, and a second set pertaining to phonemes and their adjacent neighbors. These sets of questions are supplied to a decision tree generator along with a corpus of predetermined word spelling-pronunciation pairs. The generator uses a predefined set of rules, optionally including predefined pruning rules, to grow a decision tree for each letter found in the training corpus. By providing a corpus that covers all letters of the alphabet, the decision tree generator will generate a mixed tree for each letter of the alphabet. Probability data are assigned to the leaf nodes based on the actual letter-phoneme pairs in the training corpus.

The memory containing the mixed tree data structure can be incorporated into a variety of different speech processing products. For example, the mixed tree can be connected to a speech recognition system to allow the end user to add additional words to the recognition dictionary without the need to understand the nuances of building a phonetic transcription. The decision tree can also be used in a speech synthesis system to generate pronunciations for words not found in the current dictionary.

For a more complete understanding of the invention, its objects and advantages, refer to the following specification and to the accompanying drawings.

DESCRIPTION OF THE PREFERRED EMBODIMENT

The method and resulting article of manufacture according to the invention can take different forms, depending upon the specific application. The following will present a general description of the decision-tree structure upon which the spelling-to-pronunciation system is based. The presently preferred embodiment uses a mixed-decision tree that encompasses both questions about letters and questions about phonemes. Before describing the mixed-tree data structure in detail, a simpler case, the letter-only decision tree, will be presented. In many spelling-to-pronunciation applications both the letter-only decision tree and the mixed-decision tree would be used.

In most spelling-to-pronunciation applications the system will be designed to accept an input string of letters that spell a word to be pronounced. In many cases the system will be designed to accept every letter of the alphabet for a given natural language. The present invention generates a separate decision tree for each letter of the alphabet. Thus a complete set of decision trees for the English language would comprise 26 separate decision-tree structures at a minimum. Of course, the number of trees employed is application specific. Fewer trees would be generated if certain letters are not used at all. Conversely, multiple trees can be generated for each letter. For example, in a spelling-to-pronunciation generator the system may employ two trees per letter: one letter-only tree and one mixed tree.

Figure 1:
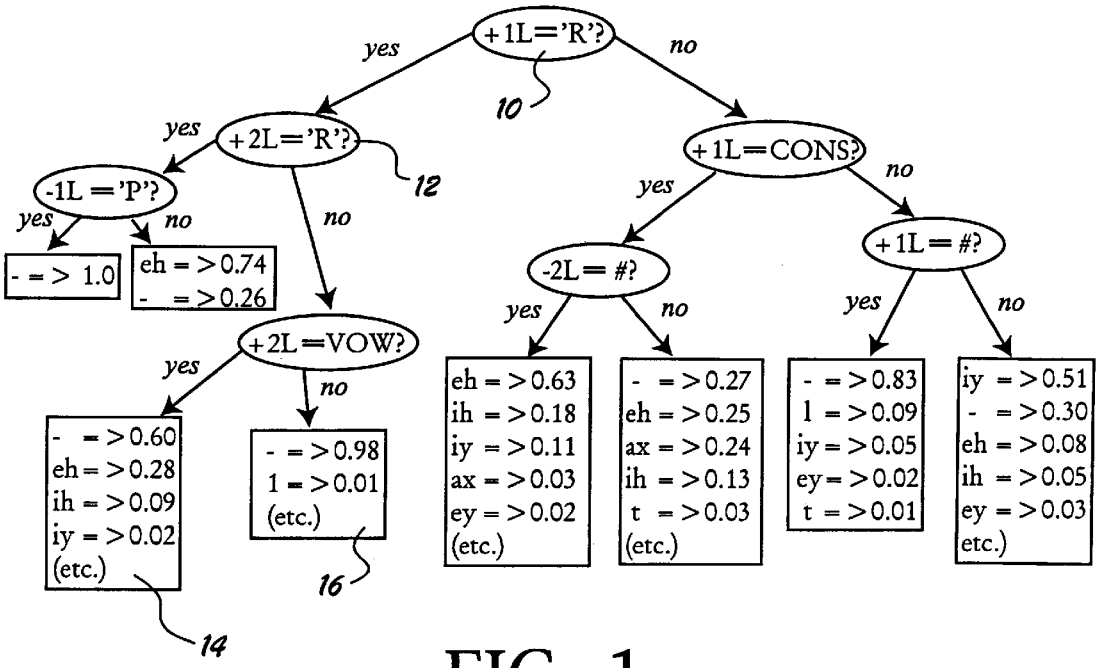
FIG. 1 is a decision-tree diagram illustrating a letter-only decision tree.

Referring to FIG. 1, an example of a letter-only tree is presented. As will be explained more fully below, the decision trees are grown through the tree generation process according to the invention. Thus the letter-only decision tree illustrated in FIG. 1 is merely an example of one possible decision tree. Nevertheless, the example in FIG. 1 illustrates the structural features found in all letter-only decision trees. The letter-only decision tree illustrated in FIG. 1 is for the letter E. The tree comprises a plurality of internal nodes such as nodes 10 and 12. Internal nodes are represented by ovals in FIG. 1. Each internal node is populated with a yes-no question and has associated with it two branches corresponding to the two possible answers: yes, no. The decision tree also includes a plurality of leaf nodes, such as nodes 14 and 16. Leaf nodes are represented by rectangles in FIG. 1. Leaf nodes are populated with probability data that associates the given letter (in this case E) with a plurality of different phoneme pronunciations.

Abbreviations are used in FIG. 1 as follows: numbers in questions, such as "+1" or "−1" refer to positions in the spelling relative to the current letter. For example, "+1L== 'R'?" means "Is the letter after the current letter (which in this case the letter E) an R?" The abbreviations CONS and VOW represent classes of letters, namely consonants and vowels. The absence of a neighboring letter, or null letter, is represented by the symbol –, which is used as a filler or placeholder when aligning certain letters with corresponding phoneme pronunciations. The symbol # denotes a word boundary.

The leaf nodes are populated with probability data that associate possible phoneme pronunciations with numeric values representing the probability that the particular phoneme represents the correct pronunciation of the given letter. For example, the notation "iy=>0.51" means "the probability of phoneme 'iy' in this leaf is 0.51." The null phoneme, i.e., silence, is represented by the symbol '–'.

Figure 2:
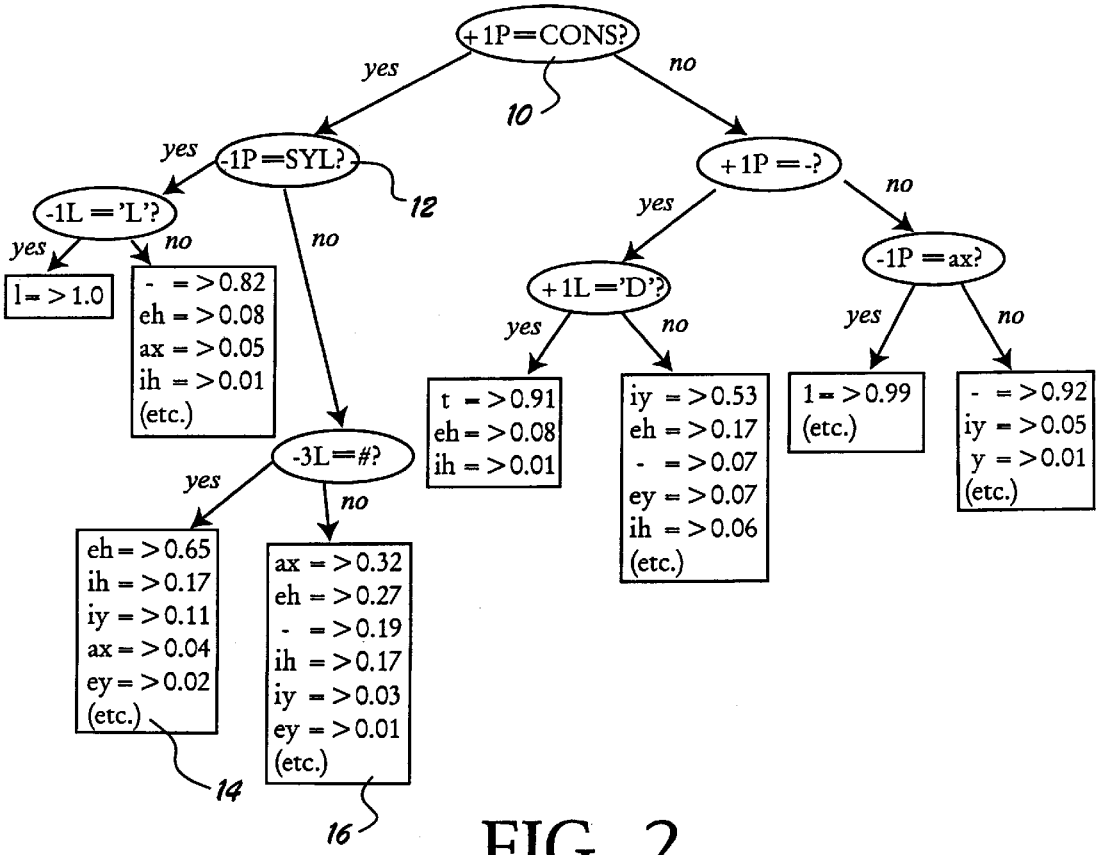
FIG. 2 is a decision-tree diagram illustrating a mixed-decision tree.

FIG. 2 illustrates the mixed-decision tree according to the invention. As with the letter-only decision tree, the mixed tree has internal nodes, such as nodes 10 and 12 and leaf nodes such as nodes 14 and 16. The internal nodes are populated with yes-no questions and the leaf nodes are populated with probability data. In this respect the mixed tree is similar in structure to the letter-only tree. The mixed tree is different from the letter-only tree in one important respect: It includes questions about letters and also questions about phonemes. Like the tree illustrated in FIG. 1, the tree in FIG. 2 is for the letter E.

The abbreviations used in FIG. 2 are similar to those used in FIG. 1, with some additional abbreviations. The symbol L represents a question about a letter and its neighboring letters. The symbol P represents a question about a phoneme and its neighboring phonemes. For example the question "+1L==='D'?" means "Is the letter next to the current letter a 'D'?" The abbreviations CONS and SYL are phoneme classes, namely consonant and syllabic. For example, the question "+1P==CONS?" means "Is the phoneme next to the current phoneme a consonant?" The numbers in the leaf nodes give phoneme probabilities as they did in the letter-only trees.

Comparing the trees of FIGS. 1 and 2, note that whereas the letter-only tree (FIG. 1) includes only questions about letters, the mixed tree (FIG. 2) includes questions about letters and also questions about phonemes. The mixed-decision tree is grown using the tree generation method described below. The actual questions that populate the internal nodes and the probability data that populate the leaf nodes will depend upon the training corpus used to grow the trees. Thus the tree illustrated in FIG. 2 is merely one example of a mixed tree in accordance with the invention.

Figure 3:
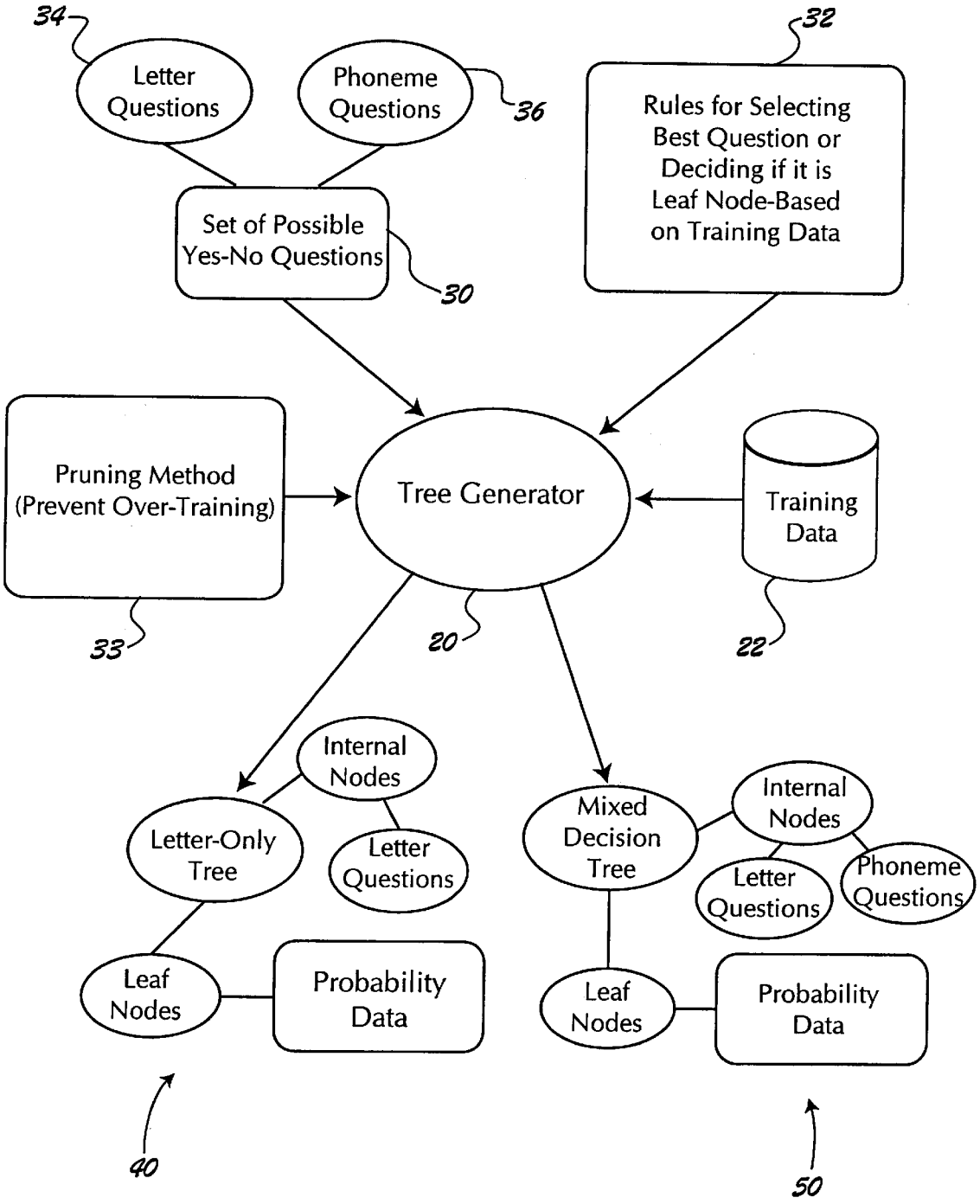
FIG. 3 is a block diagram illustrating a presently preferred system for generating the mixed tree in accordance with the invention.
Figure 4:
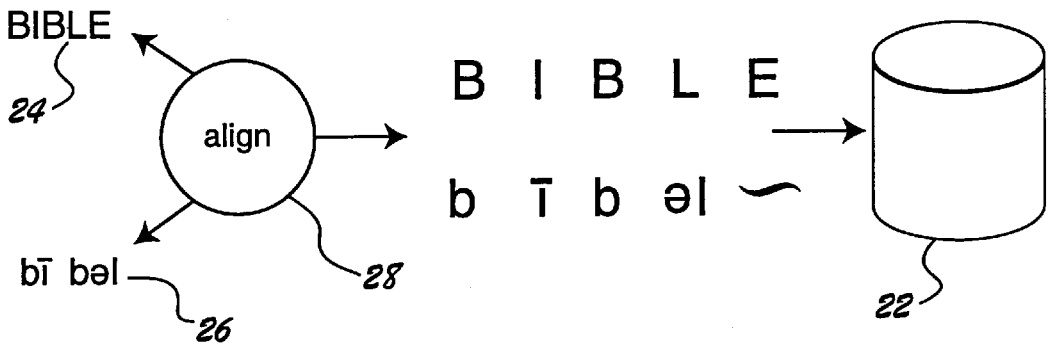
FIG. 4 is a flowchart illustrating a method for generating training data through an alignment process.

The system for generating the letter-only trees and the mixed trees is illustrated in FIG. 3. At the heart of the decision tree generation system is tree generator 20. The tree generator employs a tree-growing algorithm that operates upon a predetermined set of training data 22 supplied by the developer of the system. Typically the training data comprise aligned letter, phoneme pairs that correspond to known proper pronunciations of words. The training data may be generated through the alignment process illustrated in FIG. 4. FIG. 4 illustrates an alignment process being performed on an exemplary word BIBLE. The spelled word 24 and its pronunciation 26 are fed to a dynamic programming alignment module 28 which aligns the letters of the spelled word with the phonemes of the corresponding pronunciation. Note in the illustrated example the final E is silent. The letter phoneme pairs are then stored as data 22.

Returning to FIG. 3, the tree generator works in conjunction with three additional components: a set of possible yes-no questions 30, a set of rules 32 for selecting the best questions for each node or for deciding if the node should be a lead node, and a pruning method 33 to prevent overtraining.

The set of possible yes-no questions may include letter questions 34 and phoneme questions 36, depending on whether a letter-only tree or a mixed tree is being grown. When growing a letter-only tree, only letter questions 34 are used; when growing a mixed tree both letter questions 34 and phoneme questions 36 are used.

The rules for selecting the best question to populate at each node in the presently preferred embodiment are designed to follow the Gini criterion. Other splitting criteria can be used instead. For more information regarding splitting criteria reference may be had to Breiman, Friedman et al, "Classification and Regression Trees." Essentially, the Gini criterion is used to select a question from the set of possible yes-no questions 30 and to employ a stopping rule that decides when a node is a leaf node. The Gini criterion employs a concept called "impurity." Impurity is always a non-negative number. It is applied to a node such that a node containing equal proportions of all possible categories has maximum impurity and a node containing only one of the possible categories has a zero impurity (the minimum possible value). There are several functions that satisfy the above conditions. These depend upon the counts of each category within a node Gini impurity may be defined as follows. If C is the set of classes to which data items can belong, and T is the current tree node, let f(1|T) be the proportion of training data items in node T that belong to class 1, f(2|T) the proportion of items belonging to class 2, etc. Then, $$i(T) = \sum_{j,k \in C,\, j \neq k} f(j|T) f(k|T) = 1 - \sum_j [f(j|T)]^2.$$

To illustrate by example, assume the system is growing a tree for the letter "E." In a given node T of that tree, the system may, for example, have 10 examples of how "E" is pronounced in words. In 5 of these examples, "E" is pronounced "iy" (the sound "ee" in cheeze); in 3 of the examples "E" is pronounced "eh" (the sound of "e" in "bed") ; and in the remaining 2 examples, "E" is "–" (i.e., silent as in "e" in "maple").

Figure 6:
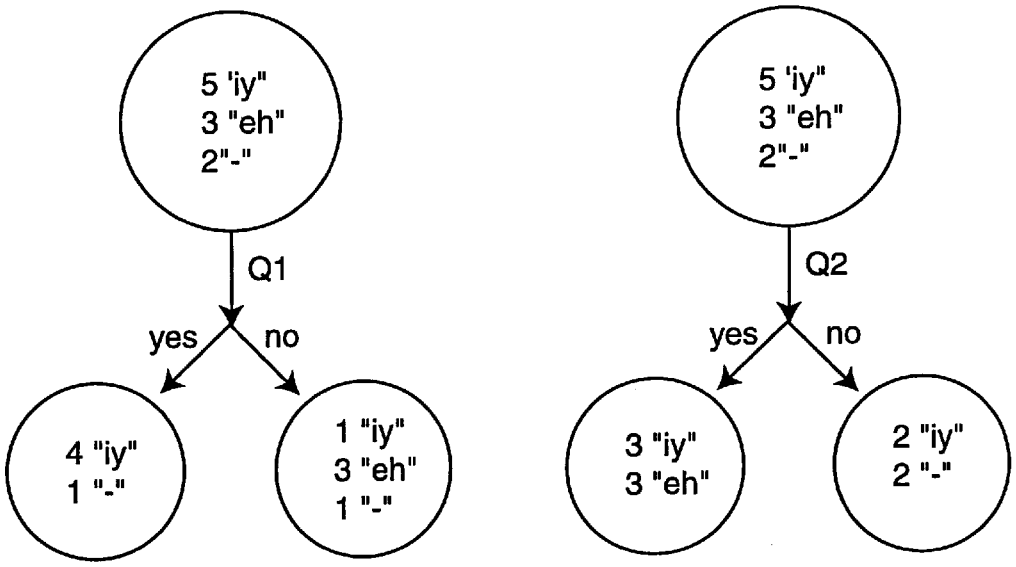
FIG. 6 illustrates application of the Gini criterion in assessing which question to use in populating a node.

Assume the system is considering two possible yes-no questions, $Q_1$ and $Q_2$ that can be applied to the 10 examples. The items that answer "yes" to $Q_1$ include four examples of "iy" and one example of "–" (the other five items answer "no" to $Q_1$.) The items that answer "yes" to $Q_2$ include three examples of "iy" and three examples of "eh" (the other four items answer "no" to $Q_2$). FIG. 6 diagrammatically compares these two cases.

The Gini criterion answers which question the system should choose for this node, $Q_1$ or $Q_2$ The Gini criterion for choosing the correct question is: find the question in which the drop in impurity in going from parent nodes to children nodes is maximized. This impurity drop ΔT is defined as $\Delta I = i(T) - p_{yes} * i(yes) - p_{no} * i(no)$, where $p_{yes}$ is the proportion of items going to the "yes" child and $p_{no}$ is the proportion of items going to the "no" child.

Applying the Gini criterion to the above example:

$$i(T) = 1 - \sum_j [f(j|T)]^2 = 1 - 0.5^2 - 0.3^2 - 0.2^2 = 0.62$$

ΔI for $Q_1$ is thus:

$$i(T) - p_{yes}(Q_1) = 1 - 0.8^2 - 0.2^2 = 0.32$$

$$i(T) - p_{no}(Q_1) = 1 - 0.2^2 - 0.6^2 = 0.56$$

So $\Delta I\ (Q_1) = 0.62 - 0.5*0.32 - 0.5*0.56 = 0.18$.

For $Q_2$, we have $I(yes, Q_2) = 1 - 0.5^2 - 0.5^2 = 0.5$, and for $i(no, Q_2) = (same) = 0.5$.

So, $\Delta I(Q_2) = 0.6 - (0.6)*(0.5) - (0.4)*(0.5) = 0.12$.

In this case, $Q_1$ gave the greatest drop in impurity. It will therefore be chosen instead of $Q_2$.

The rule set 32 declares a best question for a node to be that question which brings about the greatest drop in impurity in going from the parent node to its children.

The tree generator applies the rules 32 to grow a decision tree of yes-no questions selected from set 30. The generator will continue to grow the tree until the optimal-sized tree has been grown. Rules 32 include a set of stopping rules that will terminate tree growth when the tree is grown to a predetermined size. In the preferred embodiment the tree is grown to a size larger than ultimately desired. Then pruning methods 33 are used to cut back the tree to its desired size. The pruning method may implement the Breiman technique as described in the reference cited above.

The tree generator thus generates sets of letter-only trees, shown generally at 40 or mixed trees, shown generally at 50, depending on whether the set of possible yes-no questions 30 includes letter-only questions alone or in combination with phoneme questions. The corpus of training data 22 comprises letter, phoneme pairs, as discussed above. In growing letter-only tree s, only the letter portions of these pairs are used in populating the internal nodes. Conversely, when growing mixed trees, both the letter and phoneme components of the training data pairs may be used to populate internal nodes. In both instances the phoneme portions of the pairs are used to populate the leaf nodes. Probability data associated with the phoneme data in the lead nodes are generated by counting the number of occurrences a given phoneme is aligned with a given letter over the training data corpus.

The letter-to-pronunciation decision trees generated by the above-described method can be stored in memory for use in a variety of different speech-processing applications. While these applications are many and varied, a few examples will next be presented to better highlight some of the capabilities and advantages of these trees.

Figure 5:
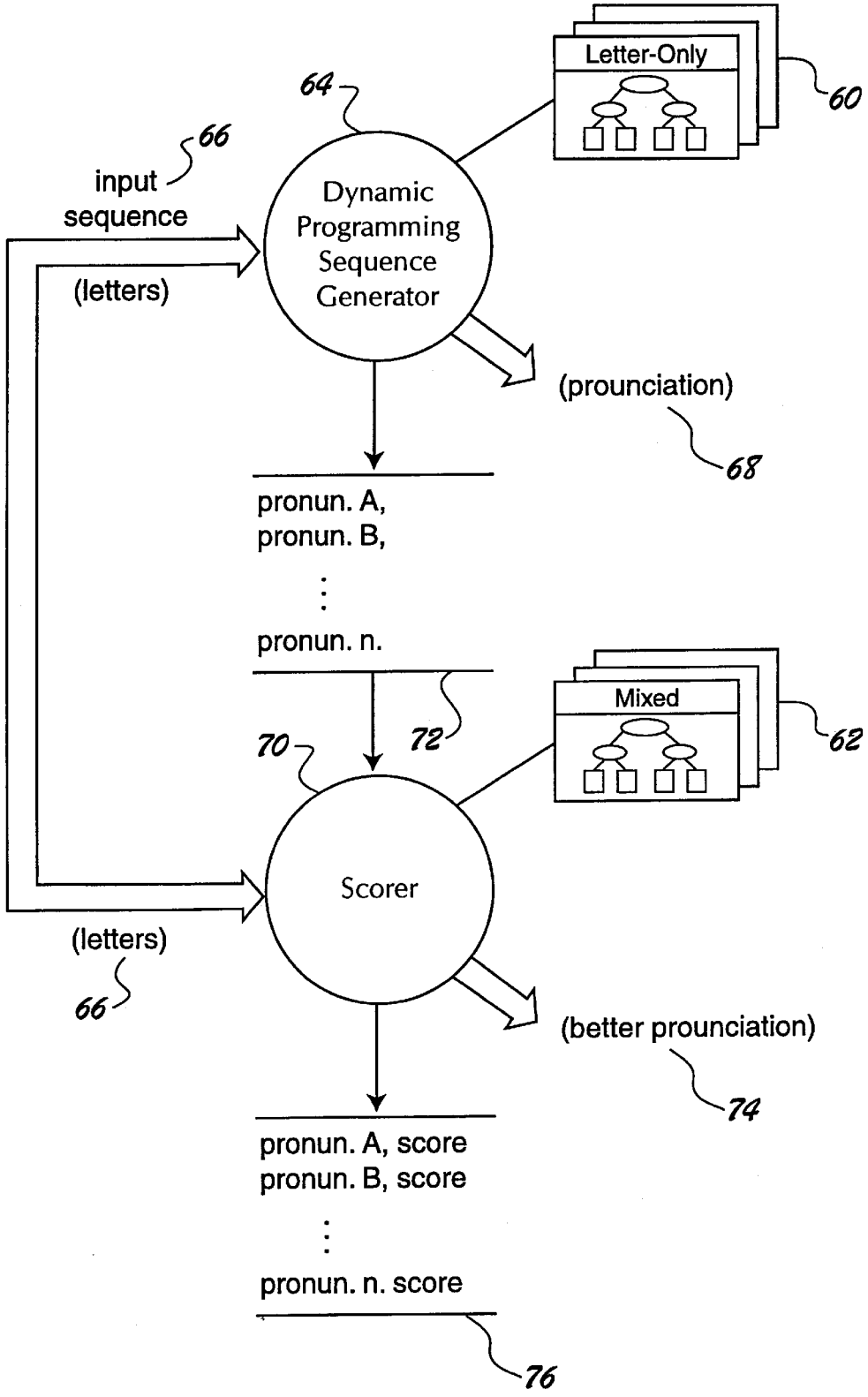
FIG. 5 is a block diagram illustrating use of the decision-tree in an exemplary pronunciation generator.

FIG. 5 illustrates the use of both the letter-only trees and the mixed trees to generate pronunciations from spelled-word letter sequences. Although the illustrated embodiment employs both letter-only and mixed tree components together, other applications may use only one component and not the other. In the illustrated embodiment the set of letter-only trees are stored in memory at 60 and the mixed trees are stored in memory at 62. In many applications there will be one tree for each letter in the alphabet. Dynamic programming sequence generator 64 operates upon input sequence 66 to generate a pronunciation at 68 based on the letter-only trees 60. Essentially, each letter in the input sequence is considered individually and the applicable letter-only tree is used to select the most probable pronunciation for that letter. As explained above, the letter-only trees ask a series of yes-no questions about the given letter and its neighboring letters in the sequence. After all letters in the sequence have been considered, the resultant pronunciation is generated by concatenating the phonemes selected by the sequence generator.

To improve pronunciation the mixed tree set 62 can be used. Whereas letter-only trees ask only questions about letters, the mixed trees can ask questions about letters and also about phonemes. Scorer 70 may receive phoneme information from the output of sequence generator 64. In this regard, sequence generator 64, using the letter-only trees 60, can generate a plurality of different pronunciations, sorting those pronunciations based on their respective probability scores. This sorted lists of pronunciations may be stored at 72 for access by the scorer 70.

Scorer 70 receives as input the same input sequence 66 as was supplied to sequence generator 64. Scorer 70 applies the mixed-tree 62 questions to the sequence of letters, using data from store 72 when asked to respond to a phoneme question. The resulting output at 74 is typically a better pronunciation than provided at 68. The reason for this is the mixed trees tend to filter out pronunciations that would not occur in natural speech. For example, the proper name, Achilles, would likely result in a pronunciation that phoneticizes both II's: ah-k-ih-I-I-iy-z. In natural speech, the second I is actually silent: ah-k-ih-I-iy-z.

If desired, scorer generator 70 can also produce a sorted list of n possible pronunciations as at 76. The scores associated with each pronunciation represent the composite of the individual probability scores assigned to each phoneme in the pronunciation. These scores can, themselves, be used in applications where dubious pronunciations need to be identified. For example, the phonetic transcription supplied by a team of lexicographers could be checked using the mixed trees to quickly identify any questionable pronunciations.

While the invention has been described in its presently preferred embodiments, it will be understood that the invention is capable of certain modification without departing from the spirit of the invention as set forth in the appended claims.

What is claimed is:

1. A memory for storing spelling-to-pronunciation data for use in analyzing an input sequence, comprising:

a decision tree data structure stored in said memory that defines a plurality of internal nodes and a plurality of leaf nodes, said internal nodes adapted for storing yes-no questions and said leaf nodes adapted for storing probability data;

a first plurality of said internal nodes being populated with letter questions about a given letter in an input sequence and its neighboring letters in said input sequence;

a second plurality of said internal nodes being populated with phoneme questions about a given phoneme in said input sequence and its neighboring phonemes in said input sequence;

said leaf nodes being populated with probability data that associates said given letter with a plurality of phoneme pronunciations such that said phoneme questions ultimately result in said phoneme pronunciations.

2. The memory of claim 1 further comprising a plurality of said decision tree data structures each being associated with a different one of a plurality of letters.

3. The memory of claim 1 wherein said internal nodes are populated based on a predetermined set of training data that includes a plurality of spelled words with associated phoneme pronunciations.

4. The memory of claim 1 wherein said leaf nodes are populated based on a predetermined set of training data that includes a plurality of spelled words with associated phoneme pronunciations.

5. The memory of claim 1 further comprising a dictionary for storing relations between phoneme sequences and words, said dictionary being adapted for coupling to a speech recognizer, and wherein said dictionary is populated at least in part based upon said decision tree.

6. A speech synthesizer incorporating the memory of claim 1 and adapted to receive as input a spelled word defined by a sequences of letters, and wherein said speech synthesizer uses said decision tree to convert at least a portion of said sequences of letters into a phonetic transcription for speech synthesis.

7. A method for processing spelling-to-pronunciation data, comprising the steps of:

providing a first set of yes-no questions about letters in an input sequence and their relationship to neighboring letters in said input sequence;

providing a second set of yes-no questions about phonemes in said input sequence and their relationship to neighboring phonemes in said input sequence;

providing a corpus of training data representing a plurality of different sets of pairs each pair containing a letter sequence and a phoneme sequence, said letter sequence selected from an alphabet;

using said first and second sets and said training data to generate decision trees for at least a portion of said alphabet, said decision trees each having a plurality of internal nodes and a plurality of leaf nodes;

populating said internal nodes with questions selected from said first and second sets; and populating said leaf nodes with the probability data that associates said portion of said alphabet with a plurality of phoneme pronunciations based on said training data, such that said phoneme pronunciations result from internal nodes populated with questions selected from both said first and second sets.

8. The method of claim 7 further comprising providing said corpus of training data as aligned letter sequence-phoneme sequence pairs.

9. The method of claim 7 wherein said step of providing a corpus of training data further comprises providing a plurality of input sequences containing sequences of phonemes representing pronunciation of words formed by said sequences of letters; and aligning selected ones of said phonemes with selected ones of said letters to define aligned letter-phoneme pairs.

10. The method of claim 7 further comprising supplying an input string of letters with at least one associated phoneme pronunciation and using said decision trees to score said pronunciation based on said probability data.

11. The method of claim 7 further comprising supplying an input string of letters with a plurality of associated phoneme pronunciations and using said decision trees to select one of said plurality of pronunciation based on said probability data.

12. The method of claim 7 further comprising supplying an input string of letters representing a word with a plurality of associated phoneme pronunciations and using said decision trees to generate a phonetic transcription of said word based on said probability data.

13. The method of claim 12 further comprising using said phonetic transcription to populate a dictionary associated with a speech recognizer.

14. The method of claim 7 further comprising supplying an input string of letters representing a word with a plurality of associated phoneme pronunciations and using said decision trees to assign a numerical score to each one of said plurality of pronunciations.

* * * * *